US009556644B2

(12) United States Patent
Yoon et al.

(10) Patent No.: US 9,556,644 B2
(45) Date of Patent: Jan. 31, 2017

(54) APPARATUS FOR OPENING AND CLOSING ENTRANCE

(71) Applicants: Byungman Yoon, Gyeonggi-do (KR); Eunsook Lee, Gyeonggi-do (KR); Chaeho Yoon, Gyeonggi-do (KR)

(72) Inventors: Byungman Yoon, Gyeonggi-do (KR); Eunsook Lee, Gyeonggi-do (KR); Chaeho Yoon, Gyeonggi-do (KR)

(73) Assignees: Byungman Yoon, Gyeonggi-Do (KR); Eunsook Lee, Gyeonggi-Do (KR); Chaeho Yoon, Gyeonggi-Do (KR)

( * ) Notice: Subject to any disclaimer, the term of this patent is extended or adjusted under 35 U.S.C. 154(b) by 153 days.

(21) Appl. No.: 14/498,370

(22) Filed: Sep. 26, 2014

(65) Prior Publication Data

US 2015/0007620 A1 Jan. 8, 2015

Related U.S. Application Data

(63) Continuation of application No. PCT/KR2013/002833, filed on Apr. 5, 2013.

(30) Foreign Application Priority Data

Apr. 5, 2012 (KR) ..... 10-2012-0035510

(51) Int. Cl.
*E05B 13/10* (2006.01)
*E05B 1/00* (2006.01)
(Continued)

(52) U.S. Cl.
CPC ..... *E05B 1/0038* (2013.01); *E05B 1/0053* (2013.01); *E05B 13/105* (2013.01); *E05B 63/22* (2013.01);
(Continued)

(58) Field of Classification Search
CPC ..... E05B 1/00; E05B 1/0038; E05B 1/0053; E05B 13/00; E05B 13/10; E05B 13/105; E05B 63/22; E05C 1/00; E05C 1/12; E05C 1/14
See application file for complete search history.

(56) References Cited

U.S. PATENT DOCUMENTS 2,124,099 A * 7/1938 Zagrzejewski ..... E05C 1/14 292/170
2,504,483 A * 4/1950 Abraham ..... E05C 1/14 292/153
(Continued)

FOREIGN PATENT DOCUMENTS

KR 100921200 10/2009
KR 102011012500 11/2011

*Primary Examiner* — Christopher Boswell
(74) *Attorney, Agent, or Firm* — Lucas & Mercanti, LLP

(57) ABSTRACT

Disclosed herein is an apparatus for opening and closing an entrance. The apparatus includes: first and second door handles which are configured to be pushed or pulled; a moving unit which is coupled to the first and second door handles; a rotating unit which is rotatably coupled on a rotating shaft and locked to the moving unit so that when the moving unit horizontally moves, the rotating unit rotates around the rotating shaft; an actuating member which is locked to the rotating unit and moved in a direction perpendicular to a direction in which the moving unit moves; a latch unit which is fixed to the actuating member so that the latch unit is ejected from or retracted into the door by the movement of the actuating member; and a restoring spring which is wrapped around the rotating shaft and fixed to the door lock housing and the rotating unit.

10 Claims, 7 Drawing Sheets

(51) Int. Cl.

| | |
|---|---|
| ***E05B 63/22*** | (2006.01) |
| ***E05C 1/14*** | (2006.01) |
| ***E05C 1/00*** | (2006.01) |
| ***E05C 1/16*** | (2006.01) |

(52) U.S. Cl.
CPC ..... *E05C 1/004* (2013.01); *E05C 1/14* (2013.01); *E05C 1/16* (2013.01); *E05B 13/108* (2013.01); *Y10T 70/5199* (2015.04); *Y10T 292/096* (2015.04)

(56) References Cited

U.S. PATENT DOCUMENTS

| | | | | | |
|---|---|---|---|---|---|
| 2,547,108 | A * | 4/1951 | Anderson | E05C 1/14 | 292/147 |
| 5,516,163 | A * | 5/1996 | Baker | E05C 1/14 | 292/165 |
| 5,564,759 | A * | 10/1996 | McNutt | E05B 1/0053 | 292/139 |
| 5,947,535 | A * | 9/1999 | Baker | E05C 1/12 | 292/165 |
| 6,139,072 | A * | 10/2000 | Lee | E05B 13/101 | 292/168 |
| 9,145,719 | B2 * | 9/2015 | Hartford | E05C 1/14 | |

* cited by examiner

APPARATUS FOR OPENING AND CLOSING ENTRANCE

CROSS-REFERENCE TO RELATED APPLICATIONS

This application is continuation of PCT/KR2013/002833, filed Apr. 5, 2013, which claims benefit of priority from Korean Patent Application No. 10-2012-0035510, filed Apr. 5, 2012, the contents of each of which are incorporated herein by reference.

FIELD OF INVENTION

The present invention relates, in general, to apparatuses for opening and closing entrances and, more particularly, to an apparatus for opening and closing an entrance which is configured such that a door can be opened in such a way that a handle of the door is pushed or pulled in a direction in which the door opens, and such that a door lock device can be locked or unlocked by rotating a locking unit installed in the handle.

BACKGROUND OF INVENTION

Prior Art Document

Korean Patent Registration No. 10-0909560 (Publication date: Jul. 27, 2009)

Korean Patent Registration No. 10-0934781 (Publication date: Dec. 31, 2009)

Generally, door lock devices are embodied in such a way that rotating handles are respectively provided on both surfaces of a door, and a latch interlocked with the handles is elastically installed in the door and retractably ejected from a side surface of the door. When a user holds one of the handles with his or her hand and rotates it, the latch is pulled into the door. In this state, when the door is pushed or pulled, it opens.

However, the conventional door lock devices are disadvantageous in that the user must rotate the handle before pushing or pulling the door to open the door. That is, to open the door that has been closed, two successive operations of rotating the handle in one direction and pushing or pulling the door are required.

Particularly, for children, the elderly and disabled persons, etc., it may be difficult to rotate the handle and pass through the door. Furthermore, if the user is using both hands to hold objects, he or she must put down at least one of the objects or have help from others. Without other's help the user must pick up the object again after opening the door and then pass through the door.

SUMMARY OF INVENTION

Accordingly, the present invention has been made keeping in mind the above problems occurring in the prior art, and an object of the present invention is to provide an apparatus for opening and closing an entrance which is operated in such a way that when a handle of a door is pushed or pulled in a direction of opening of the door, a moving unit coupled to the door handle horizontally moves and thus rotates a rotating unit; an actuating member is moved by the rotation of the rotating unit in a direction perpendicular to the direction of movement of the moving unit; a latch unit coupled to the actuating member is inserted into the door; and thus the door opens, whereby a door lock can be precisely and reliably operated, the structure of the door lock can be simplified, and convenience in operating the door lock can be enhanced.

Another object of the present invention is to provide an apparatus for opening and closing an entrance which is configured such that when pushing or pulling the door handle, a user can sense that the door opens, so that the reliability in opening and closing the door can be enhanced, the operation of locking or unlocking a door lock device can be facilitated, and the possibility of malfunction can be markedly reduced.

DETAILED DESCRIPTION OF INVENTION

In order to accomplish the above objects, the present invention provides an apparatus for opening and closing an entrance, including: first and second door handles respectively provided on first and second surfaces of a door, each of the first and second door handles being configured to be pushed or pulled; a moving unit disposed in a door lock housing installed in the door, the moving unit being coupled at a first end thereof to the first door handle and coupled at a second end thereof to the second door handle so that the moving unit is horizontally moved by pushing or pulling either the first door handle or the second door handle; a rotating unit rotatably coupled at a first end thereof on a rotating shaft, the rotating shaft being provided at a predetermined position in the moving unit, the rotating unit being locked at a second end thereof to the moving unit so that when the moving unit horizontally moves, the rotating unit rotates around the rotating shaft; an actuating member locked to the rotating unit, the actuating member being moved in a direction perpendicular to a direction in which the moving unit moves; a latch unit fixed at an end thereof to the actuating member, the latch unit being ejected from or retracted into the door by the movement of the actuating member; and a restoring spring wrapped around the rotating shaft, the restoring spring being fixed at a first end thereof to an inner surface of the door lock housing and fixed at a second end thereof to the second end of the rotating unit so that when the rotating unit is rotated, the restoring spring is compressed, and when an external force that has rotated the rotating unit is removed, the restoring spring returns the rotating unit to a pre-rotated state thereof.

The moving unit may include: a moving rod coupled at a first end thereof to the first door handle and coupled at a second end thereof to the second door handle so that the moving rod is horizontally moved by pushing or pulling either the first door handle or the second door handle; a protrusion provided at a predetermined position on the moving rod; and an opening and closing control unit locked to or released from the protrusion depending on a direction of rotation of the protrusion.

The opening and closing control unit may include: a block having a through hole in a central portion thereof so that the moving rod is disposed in the through hole, and a slot formed in a surface of the block, the slot communicating with the through hole so that the protrusion can be inserted into the slot; and a guide bar fixing the block in place, the guide bar being disposed at opposite ends thereof in the first and second door handles, respectively.

Furthermore, until the protrusion of the moving unit is locked to the block, the first and second door handles are easily pushed or pulled, and after the protrusion of the moving unit is locked to the block, when the protrusion pushes the block and the block rotates the rotating unit so that the actuating member is moved by the rotating unit, a speed at which the first and second door handles are pushed or pulled is reduced.

The apparatus may further include a locking unit installed in central portions of the first and second door handles and coupled to opposite ends of the moving rod. The locking unit controls the rotation of the moving rod. The locking unit may include a key assembly into which a key is inserted, or a manipulation lever.

Each of the first and second door handles may include: a mounting bracket fixed to a corresponding one of the first and second surfaces of the door, the mounting bracket having an internal space therein so that an end of a grip part is disposed in the internal space of the mounting bracket so as to be movable forwards and backwards; and the grip part disposed at the end thereof in the internal space of the mounting bracket, the grip part being configured to be pushed or pulled.

The rotating unit may include: a rotating shaft vertically provided at a predetermined position in the moving unit; and a link rotatably provided on the rotating shaft, the link comprising a first link and a second link integrally connected to each other to have an L shape. The link may comprise a pair of L-shaped links respectively disposed at upper and lower positions, the pair of L-shaped links being coupled to each other.

The latch unit may include: a latch coupling part passing through a side surface of the door lock housing, the latch coupling part being coupled to the actuating member; a latch bolt integrally provided on an end of the latch coupling part; and a latch casing through which the latch coupling part passes, the latch casing receiving the latch bolt therein.

In an apparatus for opening and closing an entrance according to the present invention, a door can be opened by the operation of merely pushing or pulling a door handle in a direction in which the door opens. Thus, convenience in use and practicality can be improved.

Furthermore, a user can feel in his or her hand variation of the speed at which a door handle is pushed or pulled, and thus can sense opening of the door. Therefore, the safety in opening or closing the door can be enhanced.

Moreover, the operation of locking or unlocking the opening and closing apparatus can be facilitated, so that there is no possibility of failure of the apparatus in locking or unlocking the locking unit, and the reliability can be enhanced by virtue of the increased precision of the locking or unlocking operation.

In addition, the opening and closing apparatus is operated in a pushing or pulling fashion rather than in a rotating fashion. Therefore, for places such as public offices or venues which are crowded, an accident can be prevented because it is easy to open the door. Particularly, in case of fire, if a handle of the door melts in a fire, it may be impossible to rotate the door handle. However, in the present invention, because the apparatus can be easily operated in a pushing fashion, the risk of an accident can be markedly reduced.

DESCRIPTION OF THE REFERENCE NUMERALS IN THE DRAWINGS

Figure 1:
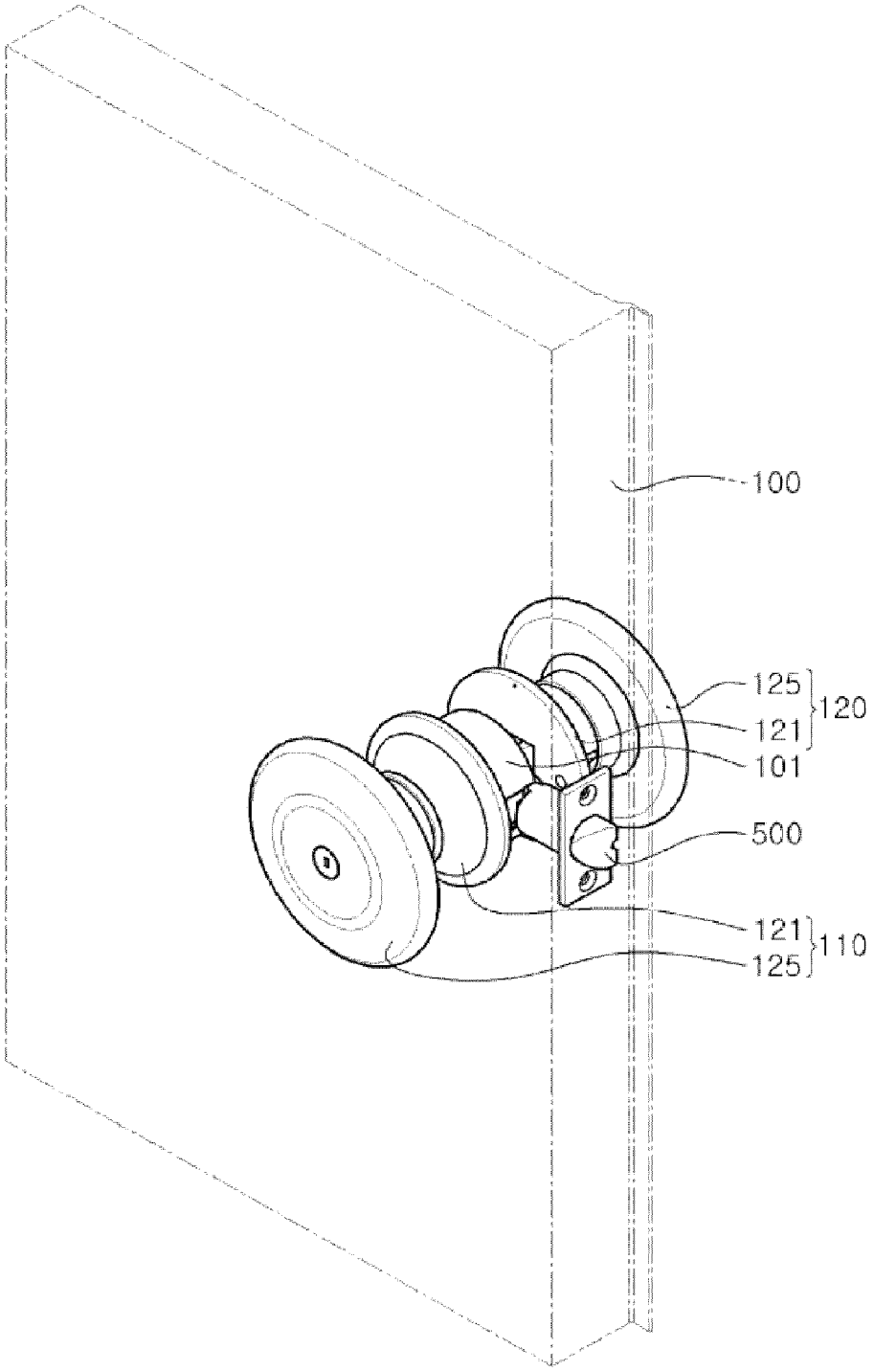
FIG. 1 is a perspective view showing the outer shape of an apparatus for opening and closing an entrance, according to the present invention.

100: door
101: door lock housing
102: auxiliary member
110: first door handle
120: second door handle
121: mounting bracket
122: receiving space
123: hole
124: fixing protrusion
125: grip part
126: insert depression
130: locking unit
200: moving unit
210: moving rod
220: protrusion
230: opening and closing control unit
231: block
232: through hole
233: opening
234: guide bar
300: rotating unit
310: rotating shaft
320: link
321: first link
322: second link
400: actuating member
410: coupling slot
420: elastic spring
500: latch unit
510: latch coupling part
520: latch bolt
530: latch casing
600: restoring spring

EXAMPLES

The above and other objects, features and advantages of the present invention will be more clearly understood from the following detailed description taken in conjunction with the accompanying drawings. Hereinafter, an apparatus for opening and closing a front entrance according to the present invention will be described in detail with reference to the attached drawings. The same reference numerals are used throughout the different drawings to designate the same or similar components, unless specifically mentioned otherwise.

Figure 2:
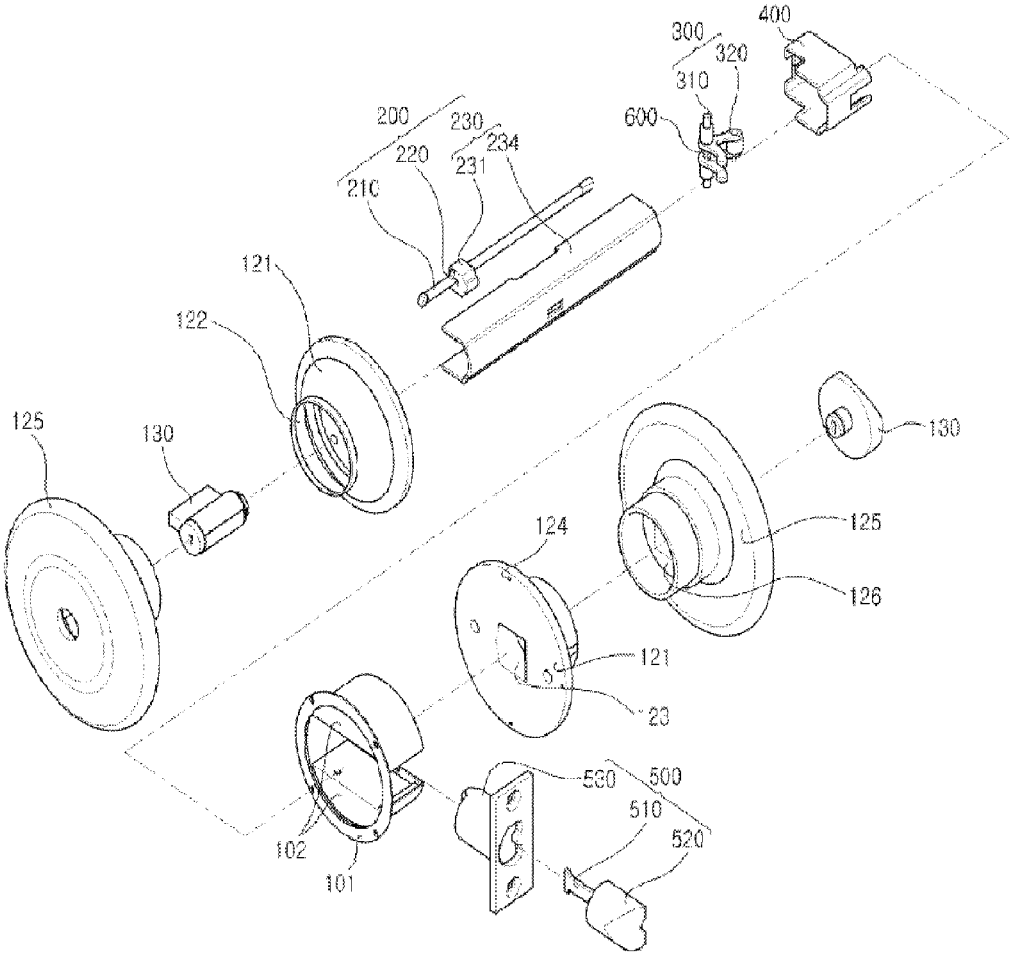
FIG. 2 is an exploded perspective view of the opening and closing apparatus according to the present invention.
Figure 3:
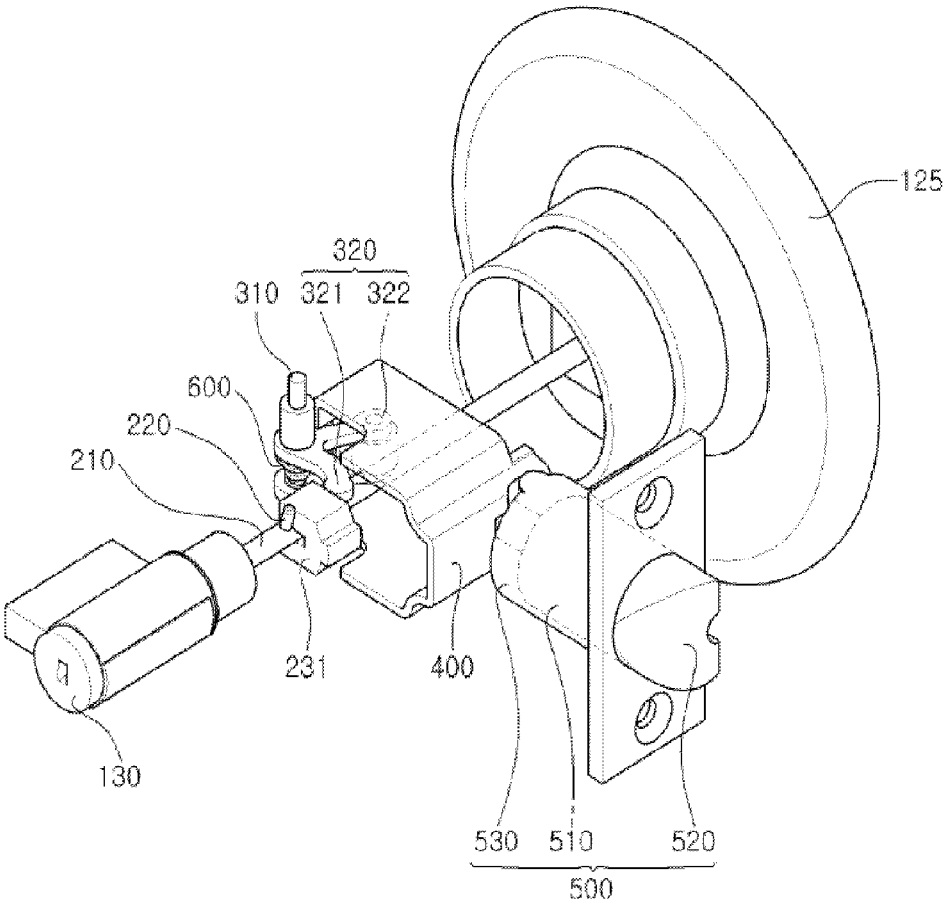
FIG. 3 is a perspective view illustrating critical parts of the opening and closing apparatus according to the present invention.

FIG. 1 is a perspective view showing the outer shape of an apparatus for opening and closing an entrance, according to the present invention. FIG. 2 is an exploded perspective view of the opening and closing apparatus according to the present invention. FIG. 3 is a perspective view illustrating critical parts of the opening and closing apparatus according to the present invention.

As shown in FIGS. 1 through 3, the apparatus for opening and closing an entrance according to the present invention includes first and second door handles 110 and 120, a moving unit 200, a rotating unit 300, an actuating member 400, a latch unit 500 and a restoring spring 600.

A door lock housing 101 having a hollow structure is installed in a door 100 in such a way that a hole defined by the door lock housing 101 passes through first and second surfaces of the door 100. The first door handle 110 and the second door handle 120 are respectively installed on the first and second surfaces of the door 100.

Each of the first and second door handles 110 and 120 includes a mounting bracket 121 which is coupled to the door 100, and a grip part 125 which is inserted into the mounting bracket 121 and configured to be pushed and pulled.

The mounting bracket 121 has a receiving space 122 in which a first end of the grip part 125 is disposed so as to be movable forwards and backwards. Communicating with the receiving space 122, a hole 123 is formed in a central portion of a surface of the mounting bracket 121 that makes contact with the door 100. A plurality of fixing protrusions 124, each of which has a pointed shape, are provided around the hole 123 on the surface of the mounting bracket 121 so that the fixing protrusions 124 can be pegged into the corresponding surface of the door 100. The hole 123 has the same shape as that of a guide bar 234 of the moving unit, and the guide bar 234 of the moving unit is disposed in the hole 123. Pegged into the surface of the door 100 that makes contact with the mounting bracket 121, the fixing protrusions 124 function to fix the mounting bracket 121 in place.

A protrusion is provided on a central portion of a first surface of the grip part 125 and disposed in the receiving space 122 of the mounting bracket so as to be movable forwards and backwards. The first end of the grip part 125 is open. An insert depression 126, having the same shape as that of the hole 123, is formed in the first end of the grip part 125. A locking unit 130 corresponding to the insert depression 126 is installed in the grip part 125. The locking unit 130 comprises a key assembly or a manipulation lever. In detail, the locking unit 130 is installed in the grip part 125 in such a way that a key insert slot of the key assembly or a manipulation surface of the manipulation lever is exposed to the outside through a second surface of the grip part 125 to allow a user to manipulate the locking unit 130. The locking unit 130 is coupled to a moving rod 210 of the moving unit that is disposed both in the hole 123 of the mounting bracket and in the insert depression 126 of the grip part.

The moving unit 200 includes the moving rod 210, a protrusion 220 and an opening and closing control unit 230. Disposed in the door lock housing 101, the moving rod 210 is coupled at a first end thereof to the locking unit 130 installed in the first door handle 110 and is coupled at a second end thereof to the locking unit 130 installed in the second door handle 120. The protrusion 220 is provided at a predetermined position on the moving rod 210. The opening and closing control unit 230 is installed on the moving rod 210 behind the protrusion 220 and is locked to or released from the protrusion 220 depending on rotation of the protrusion 220.

The moving rod 210 is horizontally moved by the operation of pushing or pulling the first or second door handle 110 or 120 and is rotated to the left or right by operating the locking unit 130. Here, the protrusion 220 provided on the moving rod 210 is also rotated to the left or right by the rotation of the moving rod 210.

The opening and closing control unit 230 includes a block 231 which is stopped by the protrusion 220, and a guide bar 234 which fixes the block 231 in place and of which opposite ends are respectively inserted into the insert depressions 114 and 124 formed in the first and second door handles 110 and 120. The block 231 has a central portion thereof a through hole 232 in which the moving rod 210 is disposed. Communicating with the through hole 232, a slot 233 is formed in a surface of the block 231. The protrusion 220 can be removably inserted into the slot 233. Depending on the operation of the locking unit 130, the protrusion 220 provided on the moving rod 210 may be oriented in the vertical direction and thus locked to the block 231 around the through hole 232, or the protrusion 220 may be rotated from the vertically oriented state and aligned with the slot 233 formed in the block 231. While the protrusion 220 provided on the moving rod 210 is locked to the block 231 around the through hole 232, when the moving rod 220 is horizontally moved, the opening and closing control unit 230 is pushed by the protrusion 220 and thus integrally moved along with the moving rod 210. While the protrusion 220 provided on the moving rod 210 is aligned with the slot 233 of the block 231, when the moving rod 210 is moved, the protrusion 220 passes through the slot 233 of the block 231 so that the opening and closing control unit 230 does not move.

The rotating unit 300 includes a rotating shaft 310 which is provided at a predetermined position in the moving unit 200 and oriented in the vertical direction, and a link 320 which is rotatably provided on the rotating shaft 310.

The rotating shaft 310 is vertically fixed to upper and lower inner surfaces of the door lock housing 101. For this, an auxiliary member 102 is preferably installed in the door lock housing 101. The auxiliary member 102 provides planar surfaces for facilitating fixing of the rotating shaft 310 to the door lock housing 101.

The link 320 includes a first link 321 and a second link 322 which are integrally connected to each other to have an L shape. A medial portion of the link 320 at which the first and second links are connected to each is fitted over the rotating shaft. An end of the first link 321 makes contact with a rear surface of the block 231, and an end of the second link 322 is disposed in the actuating member 400 which will be described later herein. To increase a contact area between the link 320 and the block 231 or the actuating member 400, the L-shaped link 320 preferably comprises a pair of L-shaped links 320 which are respectively disposed at upper and lower positions and coupled to each other.

The link 320 of the rotating unit 300 is rotated around the rotating shaft 310 in such a way that the first link 321 is pushed by the block 231 that is pushed by the protrusion 220 when the moving rod 210 horizontally moves.

The actuating member 400 is disposed within a range in which when the link 320 is rotated the actuating member 400 can be caught by the second link 322. The actuating member 400 has a hollow structure so that the moving rod 210 and the guide bar 234 are disposed in the actuating member 400. The actuating member 400 is oriented perpendicular to the moving rod 210. A coupling slot 410 is formed in a first surface of the actuating member 400, that is, in a surface thereof that is perpendicular to the moving rod 210. The latch unit 500 is coupled to the actuating member 400 through the coupling slot 410. Connected to the inner surface of the door lock housing 101, an elastic spring 420 is coupled to a second surface of the actuating member 400.

When the link 320 rotates, the actuating member 400 is caught by the second link 322 and thus moved in a direction corresponding to the direction in which the link 320 rotates, that is, in a direction perpendicular to the direction in which the moving rod 210 moves.

The latch unit 500 includes a latch coupling part 510 which is coupled to the actuating member 400 through the coupling slot 410 and passes through the first surface of the door lock housing 101, a latch bolt 520 which is integrally provided on an end of the latch coupling part 510, and a latch casing 530 which houses the latch bolt 520 therein. The latch casing 530 is installed in the door 100 and coupled to a side surface of the door 100. The latch casing 530 is open on one surface thereof so that the latch bolt 520 housed in the latch casing 530 can protrude outwards from the latch casing 530.

The latch bolt 520 is ejected outwards from the door 100 or retracted therein depending on movement of the actuating member 400. When the latch bolt 520 is ejected outwards from the door 100, the door 100 is locked. When the latch bolt 520 is retracted into the door 100, the door 100 is opened.

The restoring spring 600 is wrapped around the rotating shaft 310 of the rotating unit 300. A first end of the restoring spring 600 is fixed to the inner surface of the door lock housing 101, and a second end thereof is fixed to the end of the first link 321. Therefore, the restoring spring 600 is compressed by rotation of the link 320, and when the external force that has rotated the link 320 is removed, the restoring spring 600 returns to its pre-compressed state so that the link 320 can return to its pre-rotated state.

The operation of the opening and closing apparatus having the above-mentioned construction will be described below.

When the opening and closing apparatus is locked, the door 100 can be maintained in a closed state. When the opening and closing apparatus is unlocked, the door 100 can open.

Figure 4:
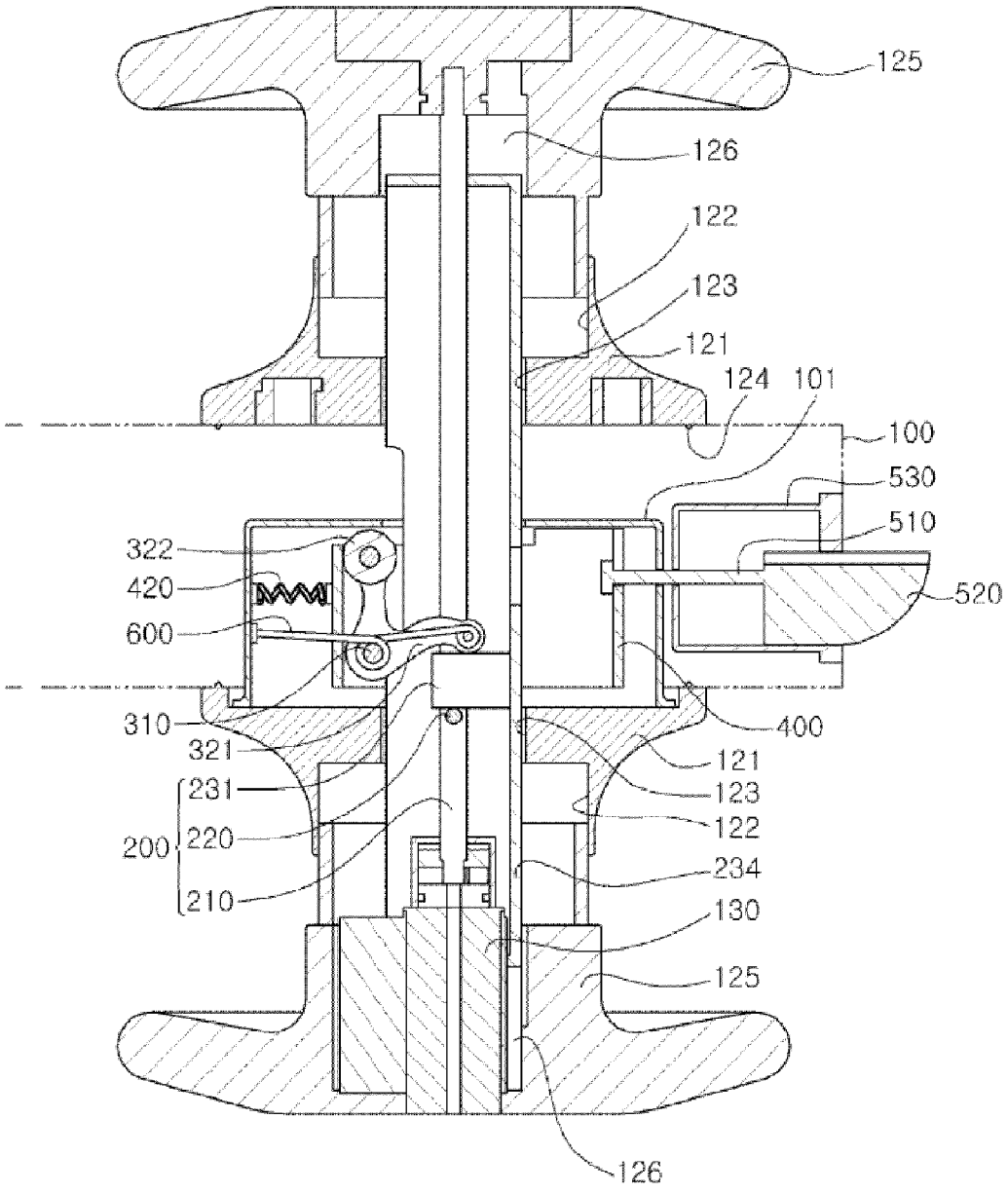
FIG. 4 is a view illustrating a door opening operation of the opening and closing apparatus according to the present invention.
Figure 5:
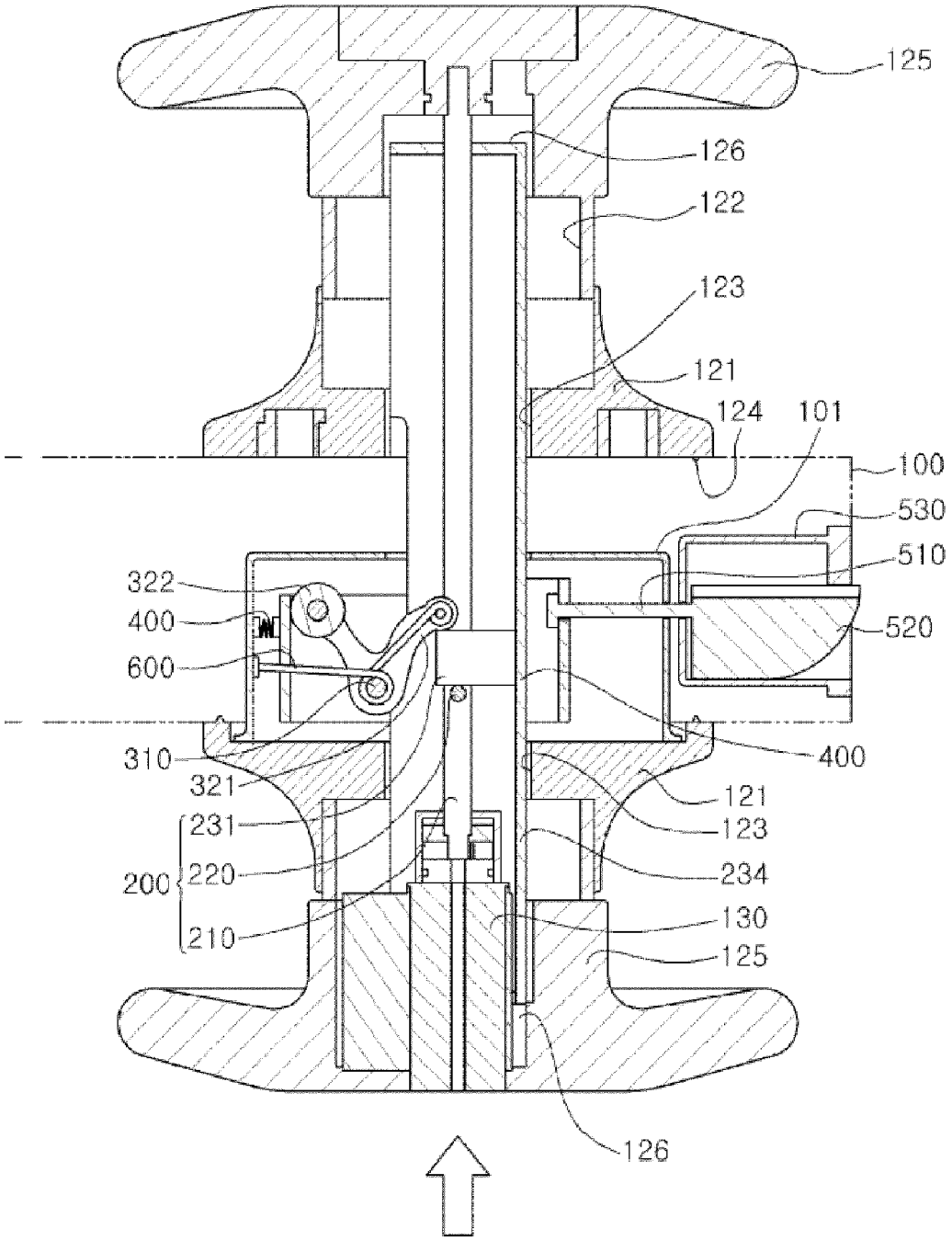
FIG. 5 is a view illustrating a door closing operation of the opening and closing apparatus according to the present invention.

FIG. 4 is a view illustrating a closed state of the door when the opening and closing apparatus according to the present invention is in the unlocked state. FIG. 5 is a view illustrating the operation of opening the door when the opening and closing apparatus according to the present invention is in the unlocked state.

As shown in FIG. 4, to unlock the opening and closing apparatus, the key is inserted into the locking unit 130 provided in the first or second door handle 110 or 120 and rotated in a first direction, or the manipulation lever is rotated in the first direction so that the protrusion 220 of the moving rod 210 connected to the locking unit 130 is disposed at a position at which the protrusion 220 is locked to the block 231.

In this state, as shown in FIG. 5, when the grip part 125 of the first or second door handle 110 or 120 is pushed or pulled, the moving rod 210 is horizontally moved so that the protrusion 220 provided on the moving rod 210 pushes the block 231. Then, the block 231 is pushed by the protrusion 220 and thus moved along with the moving rod 210. Simultaneously, the guide bar 234 that supports the block 231 is moved along with the block 231. In addition, the first link 312 of the rotating unit 300 that makes contact with the rear surface of the block 231 is pushed by the block 231 and thus rotated around the rotating shaft 310. Then, the second link 322 that is integrated with the first link 321 also rotates and thus pushes the actuating member 400 that is caught by the second link 322. The actuating member 400 that is pushed by the second link 322 is moved in the direction perpendicular to the direction in which the moving rod 210 moves. Consequently, the latch bolt 520 that is coupled to the actuating member 400 is retracted into the latch casing 530 and the door 100 by the movement of the actuating member 400, thus allowing opening of the door 100. During the above operation, the restoring spring 600 that is wrapped around the rotating shaft 310 is compressed by the rotation of the rotating unit 300, and the elastic spring 420 that is provided between the actuating member 400 and the door lock housing 101 is also compressed by the movement of the actuating member 400.

In the state of FIG. 5, when the first or second door handle 110 or 120 that has been pushed or pulled is released, in other words, when the external force that has been applied to the first or second door handle 110 or 120 is removed, the restoring spring 600 that has been compressed returns to its original state, thus returning the link 320 to the pre-rotated state. Then, the first link 321 pushes the block 231 while returning to the pre-rotated state. The block 231 that is pushed by the first link 321 pushes the protrusion 220 that is locked to the block 231. Thereby, the moving rod 210 returns to its original state. While the second link 322 returns to the pre-rotated state, it releases the actuating member 400 that has been pushed by the second link 322. The actuating member 400 from which the pushing force of the second link 322 is removed is returned to its original position by the restoring force of the elastic spring 420. Then, the latch bolt 520 that has been received in the latch casing 530 is ejected outwards from the door 100 by the movement of the actuating member 400 so that the door 100 enters the closed state of FIG. 4.

Figure 6:
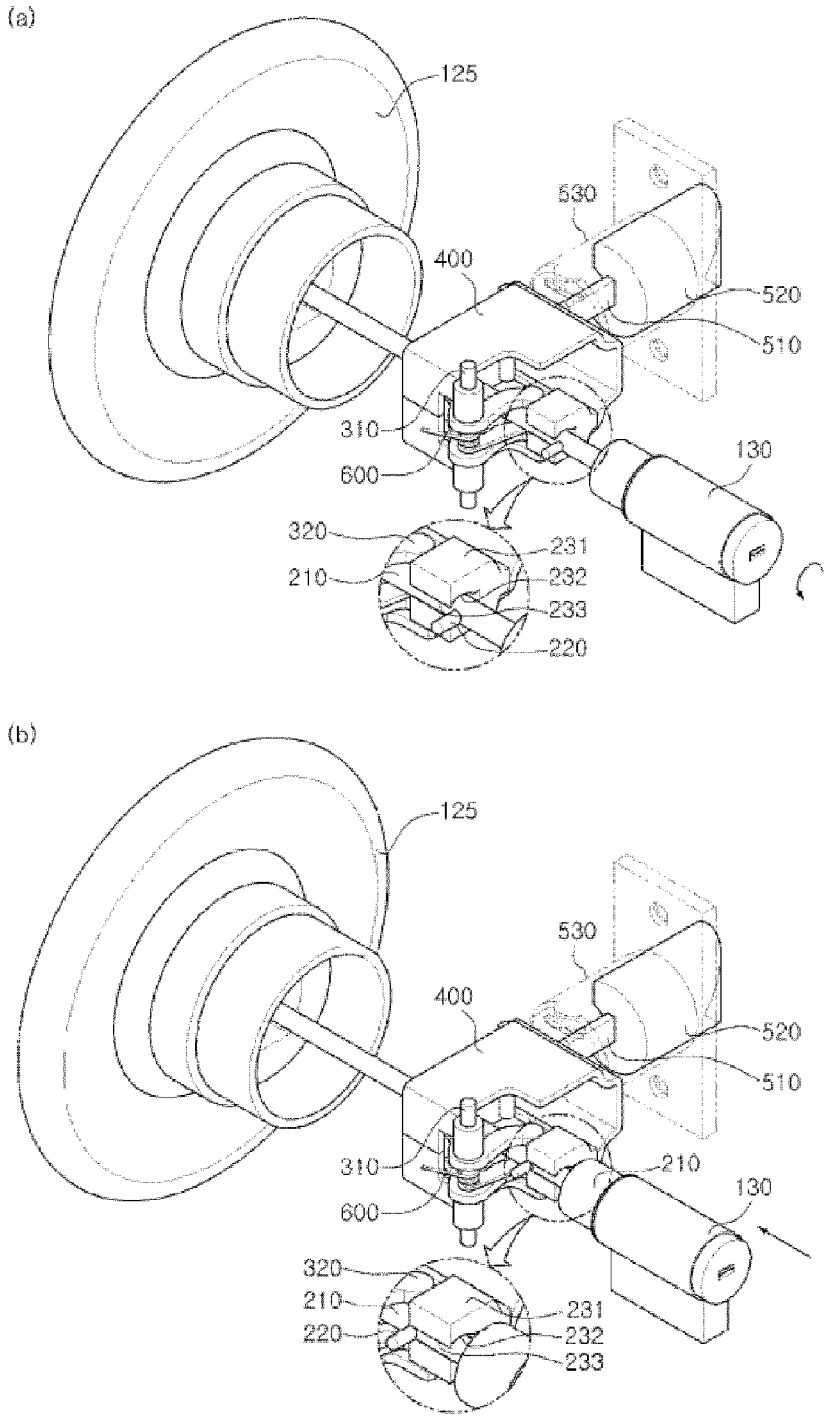
FIG. 6 is a view illustrating a locked state of the opening and closing apparatus according to the present invention.
Figure 7:
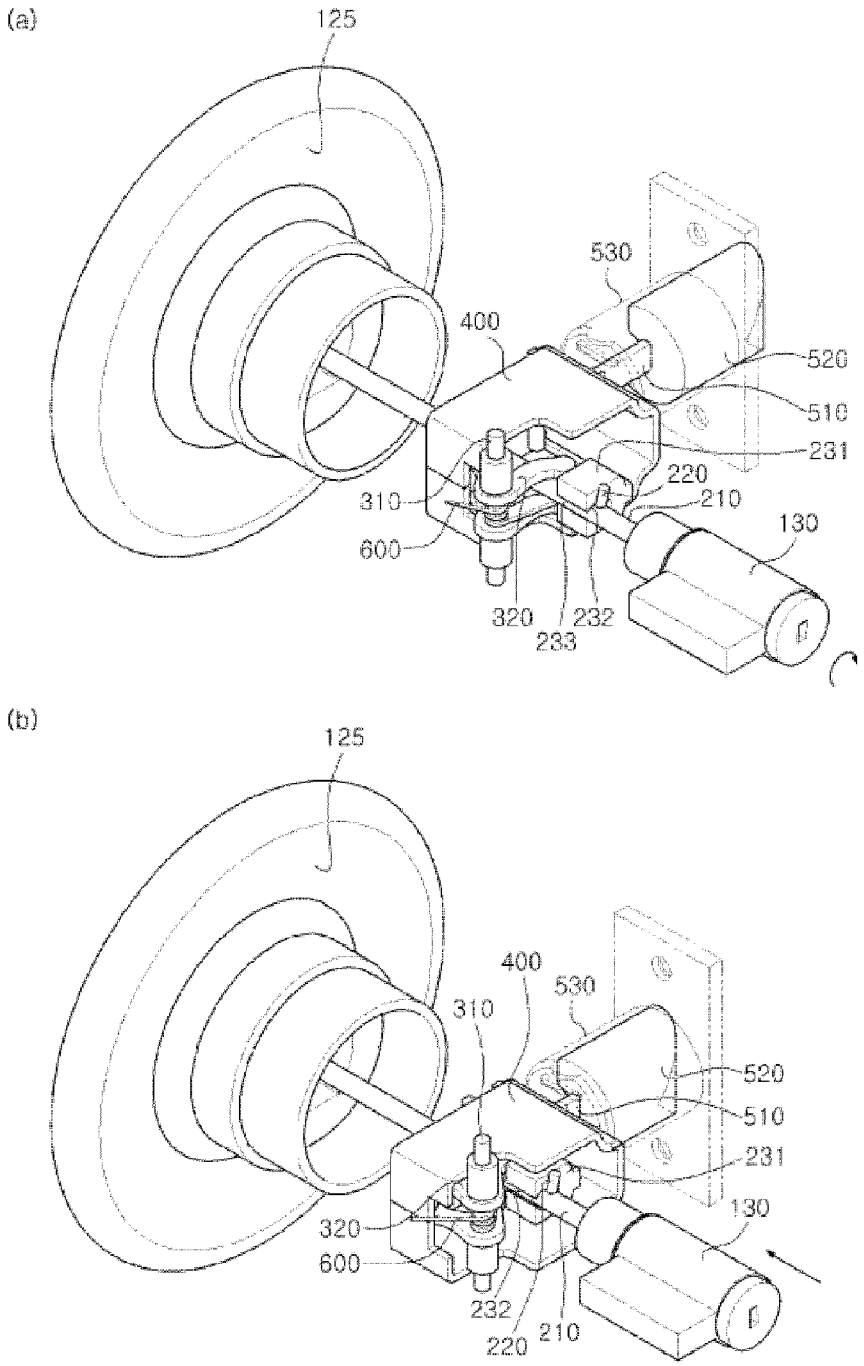
FIG. 7 is a view illustrating an unlocked state of the opening and closing apparatus according to the present invention.

FIGS. 6*a* and 6*b* are views illustrating a locked state of the opening and closing apparatus according to the present invention. FIGS. 7*a* and 7*b* are views illustrating an unlocked state of the opening and closing apparatus according to the present invention.

To lock the door such that the door is prevented from opening, the opening and closing apparatus must maintain the latch bolt that has been ejected outwards from the door.

As shown in FIG. 6*a*, to lock the opening and closing apparatus from the state of FIG. 4, the key is inserted into the locking unit 130 provided in the first or second door handle 110 or 120 and thereafter rotated in a second direction, or the manipulation lever is rotated in the second direction. Then, the moving rod 210 connected to the locking unit 130 is rotated in the second direction so that the protrusion 220 is located at a position corresponding to the slot 233 of the block 231. In this state, as shown in FIG. 6*b*, when the grip part 125 of the first or second door handle 110 or 120 is pushed or pulled, the moving rod 210 is horizontally moved, and the protrusion 220 provided on the moving rod 210 enters the slot 233 of the block 231 and passes through the block 231 while the moving rod 210 moves. Therefore, the block 231 does not move because it is not pushed by the protrusion 220. Because the block 231 does not move, neither the rotating unit 300 nor the actuating member 400 moves. The latch bolt 520 is maintained in the ejected state so that the door 100 is maintained in the closed state as it is. Consequently, even when the first or second door handle 110 or 120 is pushed or pulled, the door 100 does not open.

As shown in FIG. 7*a*, when the locking unit 130 provided in the first or second door handle 110 or 120 is rotated in the first direction from the state of FIG. 6*a*, the moving rod 210 connected to the locking unit 130 is rotated in the first direction. Then, the protrusion 220 provided on the moving rod 210 is located at the position at which the protrusion 220 is locked to the block 231, whereby the opening and closing apparatus enters the unlocked state as described above. As shown in FIG. 7*b*, while the protrusion 220 provided on the moving rod 210 is located at the position at which the protrusion 220 is locked to the block 231, when the first or second door handle 110 or 120 is pushed or pulled in a direction in which the door 100 opens, the moving rod 210 coupled to the first and second door handles 110 and 120 is horizontally moved. Then, the protrusion 220 provided on the moving rod 210 pushes the block 231, and the rotating unit 300 is rotated by the movement of the block 231. The actuating member 400 is moved by the rotation of the rotation unit 300 in the direction perpendicular to the direction in which the moving rod 210 is moved. Consequently, the latch bolt 520 coupled to the actuating member 400 is retracted into the door 100, thus allowing the opening of the door 100.

In the opening and closing apparatus operated in the above-mentioned fashion, when the user pushes, to open the door 100, the grip part 125 of the first or second door handle 110 or 120 in the direction in which the door 100 opens, the grip part 125 is pressed by the pushing force so that moving unit 200 is moved. Here, until the protrusion 220 of the moving unit 200 comes into contact with the block 231, the grip part 125 is easily pushed. When the protrusion 220 of the moving unit 200 makes contact with the block 231 and pushes the blocks 231, and when the block 231 rotates the link 320 so that the actuating member 400 is moved by the link 320, the speed at which the grip part 125 is pushed and moved is reduced. Therefore, the user can feel in his or her hand variation of the speed of the grip part 125, that is, a reduction in the speed at which the grip part 125 is pushed. Thus, the user can sense that the door 100 opens.

As described above, in an apparatus for opening and closing an entrance according to the present invention, a user can feel in his or her hand variation of the speed at which a door handle is pushed or pulled, and thus can sense the opening of the door. Therefore, the safety in opening or closing the door can be enhanced.

Furthermore, because the door is opened in such a way that the user pushes or pulls the door handle in a direction in which the door opens, convenience in use and practicality can be improved.

In addition, thanks to the simple structure of the apparatus, the number of parts of the apparatus can be reduced, the assembly process can be facilitated, and the productivity can be enhanced.

Moreover, the operation of locking or unlocking the opening and closing apparatus can be facilitated, so that there is no possibility of failure of the apparatus in locking or unlocking the locking unit, and the reliability can be enhanced by virtue of the increased precision of the locking or unlocking operation.

Furthermore, the opening and closing apparatus is operated in a pushing or pulling fashion rather than in a rotating fashion. Therefore, for places such as public offices or venues which are crowded, an accident can be prevented because it is easy to open the door. Particularly, in case of fire, if a handle of the door melts in a fire, it may be impossible to rotate the door handle. However, in the present invention, because the apparatus can be easily operated in a pushing fashion, the risk of an accident can be markedly reduced.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

We claim:

1. An apparatus for opening and closing an entrance, comprising:

first and second door handles respectively provided on first and second surfaces of a door, each of the first and second door handles being configured to be pushed or pulled;

a moving unit disposed in a door lock housing installed in the door, the moving unit being coupled at a first end thereof to the first door handle and coupled at a second end thereof to the second door handle so that the moving unit is horizontally moved by pushing or pulling either the first door handle or the second door handle;

a rotating unit rotatably coupled at a first end thereof on a rotating shaft, the rotating shaft being provided at a predetermined position in the moving unit, the rotating unit being locked at a second end thereof to the moving unit so that when the moving unit horizontally moves, the rotating unit rotates around the rotating shaft;

an actuating member locked to the rotating unit, the actuating member being moved in a direction perpendicular to a direction in which the moving unit moves;

a latch unit fixed at an end thereof to the actuating member, the latch unit being ejected from or retracted into the door by the movement of the actuating member; and a restoring spring wrapped around the rotating shaft, the restoring spring being fixed at a first end thereof to an inner surface of the door lock housing and fixed at a second end thereof to the second end of the rotating unit so that when the rotating unit is rotated, the restoring spring is compressed, and when an external force that has rotated the rotating unit is removed, the restoring spring returns the rotating unit to a pre-rotated state thereof.

2. The apparatus of claim 1, wherein the moving unit comprises:

a moving rod coupled at a first end thereof to the first door handle and coupled at a second end thereof to the second door handle so that the moving rod is horizontally moved by pushing or pulling either the first door handle or the second door handle;

a protrusion provided at a predetermined position on the moving rod; and an opening and closing control unit locked to or released from the protrusion depending on a direction of rotation of the protrusion.

3. The apparatus of claim 2, wherein the opening and closing control unit comprises:

a block having: a through hole in a central portion thereof so that the moving rod is disposed in the through hole; and a slot formed in a surface of the block, the slot communicating with the through hole so that the protrusion can be inserted into the slot; and a guide bar fixing the block in place, the guide bar being disposed at opposite ends thereof in the first and second door handles, respectively.

4. The apparatus of claim 1, wherein until the protrusion of the moving unit is locked to the block, the first and second door handles are easily pushed or pulled, and after the protrusion of the moving unit is locked to the block, when the protrusion pushes the block and the block rotates the rotating unit so that the actuating member is moved by the rotating unit, a speed at which the first and second door handles are pushed or pulled is reduced.

5. The apparatus of claim 1, further comprising a locking unit installed in central portions of the first and second door handles and coupled to opposite ends of the moving rod, the locking unit controlling rotation of the moving rod.

6. The apparatus of claim 5, wherein the locking unit comprises a key assembly into which a key is inserted, or a manipulation lever.

7. The apparatus of claim 1, wherein each of the first and second door handles comprises:

a mounting bracket fixed to a corresponding one of the first and second surfaces of the door, the mounting bracket having an internal space therein so that an end of a grip part is disposed in the internal space of the mounting bracket so as to be movable forwards and backwards; and the grip part disposed at the end thereof in the internal space of the mounting bracket, the grip part being configured to be pushed or pulled.

8. The apparatus of claim 1, wherein the rotating unit comprises:

a rotating shaft vertically provided at a predetermined position in the moving unit; and a link rotatably provided on the rotating shaft, the link comprising a first link and a second link integrally connected to each other to have an L shape.

9. The apparatus of claim 8, wherein the link comprises a pair of L-shaped links respectively disposed at upper and lower positions, the pair of L-shaped links being coupled to each other.

10. The apparatus of claim 1, wherein the latch unit comprises:

a latch coupling part passing through a side surface of the door lock housing, the latch coupling part being coupled to the actuating member;

a latch bolt integrally provided on an end of the latch coupling part; and a latch casing through which the latch coupling part passes, the latch casing receiving the latch bolt therein.

* * * * *